US006709534B2

(12) United States Patent
Kusinski et al.

(10) Patent No.: US 6,709,534 B2
(45) Date of Patent: Mar. 23, 2004

(54) NANO-COMPOSITE MARTENSITIC STEELS

(75) Inventors: Grzegorz J. Kusinski, Berkeley, CA (US); David Pollack, Tustin, CA (US); Gareth Thomas, Sonoma, CA (US)

(73) Assignee: MMFX Technologies Corporation, Irvine, CA (US)

( * ) Notice: Subject to any disclaimer, the term of this patent is extended or adjusted under 35 U.S.C. 154(b) by 0 days.

(21) Appl. No.: 10/017,879

(22) Filed: Dec. 14, 2001

(65) Prior Publication Data

US 2003/0111146 A1 Jun. 19, 2003

(51) Int. Cl.[7] ..... C22C 38/00; C22C 38/18

(52) U.S. Cl. ..... 148/320; 148/333; 148/325; 148/327; 148/336

(58) Field of Search ..... 148/320, 333, 148/336, 579, 325, 327

(56) References Cited

U.S. PATENT DOCUMENTS 4,170,497 A 10/1979 Thomas et al.
4,170,499 A 10/1979 Thomas et al.
4,619,714 A 10/1986 Thomas et al.
4,671,827 A 6/1987 Thomas et al.
5,180,450 A * 1/1993 Rao ..... 148/579
6,273,968 B1 * 8/2001 Thomas ..... 148/333

OTHER PUBLICATIONS

Lab Manual: "ME 2151–1 Cooling Rate Effect", Session: 2003/2004, Department of Mechanical Engineering, National University of Singapore.

* cited by examiner

*Primary Examiner*—Deborah Yee
(74) *Attorney, Agent, or Firm*—M. Henry Heines; Townsend and Townsend and Crew LLP

(57) ABSTRACT

Carbon steels of high performance are disclosed that contain dislocated lath structures in which laths of martensite alternate with thin films of austenite, but in which each grain of the dislocated lath structure is limited to a single microstructure variant by orienting all austenite thin films in the same direction. This is achieved by careful control of the grain size to less than ten microns. Further improvement in the performance of the steel is achieved by processing the steel in such a way that the formation of bainite, pearlite, and interphase precipitation is avoided.

8 Claims, 1 Drawing Sheet

Fig. 1 - Prior Art
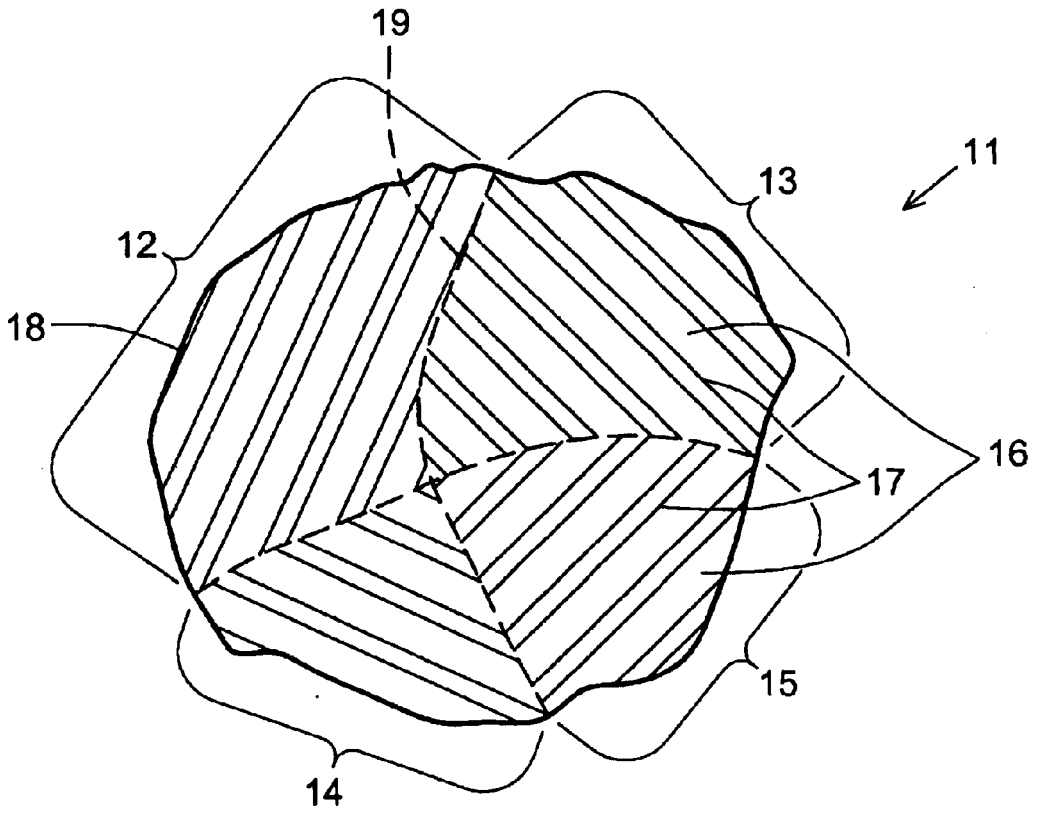
Fig. 2
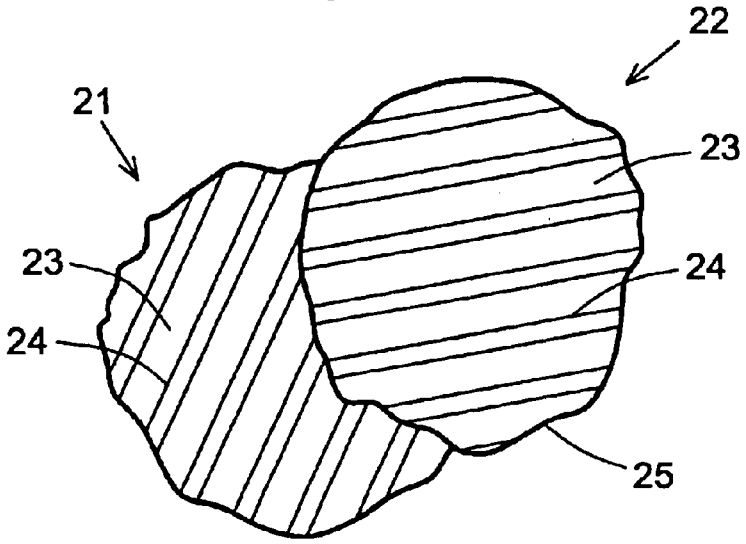

NANO-COMPOSITE MARTENSITIC STEELS

BACKGROUND OF THE INVENTION

1. Field of the Invention

This invention resides in the field of steel alloys, particularly those of high strength, toughness, corrosion resistance, and cold formability, and also in the technology of the processing of steel alloys to form microstructures that provide the steel with particular physical and chemical properties.

2. Description of the Prior Art

Steel alloys of high strength and toughness and cold formability whose microstructures are composites of martensite and austenite phases are disclosed in the following United States patents, each of which is incorporated herein by reference in its entirety:

- U.S. Pat. No. 4,170,497 (Gareth Thomas and Bangaru V. N. Rao), issued Oct. 9, 1979 on an application filed Aug. 24, 1977
- U.S. Pat. No. 4,170,499 (Gareth Thomas and Bangaru V. N. Rao), issued Oct. 9, 1979 on an application filed Sep. 14, 1978 as a continuation-in-part of the above application filed on Aug. 24, 1977
- U.S. Pat. No. 4,619,714 (Gareth Thomas, Jae-Hwan Ahn, and Nack-Joon Kim), issued Oct. 28, 1986 on an application filed Nov. 29, 1984, as a continuation-in-part of an application filed on Aug. 6, 1984
- U.S. Pat. No. 4,671,827 (Gareth Thomas, Nack J. Kim, and Ramamoorthy Ramesh), issued Jun. 9, 1987 on an application filed on Oct. 11, 1985
- U.S. Pat. No. 6,273,968 B1 (Gareth Thomas), issued Aug. 14, 2001 on an application filed on Mar. 28, 2000

The microstructure plays a key role in establishing the properties of a particular steel alloy, and thus strength and toughness of the alloy depend not only on the selection and amounts of the alloying elements, but also on the crystalline phases present and their arrangement. Alloys intended for use in certain environments require higher strength and toughness, and in general a combination of properties that are often in conflict, since certain alloying elements that contribute to one property may detract from another.

The alloys disclosed in the patents listed above are carbon steel alloys that have microstructures consisting of laths of martensite alternating with thin films of austenite. In some cases, the martensite is dispersed with fine grains of carbides produced by autotempering. The arrangement in which laths of one phase are separated by thin films of the other is referred to as a "dislocated lath" structure, and is formed by first heating the alloy into the austenite range, then cooling the alloy below the martensite start temperature $M_s$, which is the temperature at which the martensite phase first begins to form, into a temperature range in which austenite transforms into packets consisting of martensite laths separated by thin films of untransformed, stabilized austenite. This is accompanied by standard metallurgical processing, such as casting, heat treatment, rolling, and forging, to achieve the desired shape of the product and to refine the alternating lath and thin film arrangement. This microstructure is preferable to the alternative of a twinned martensite structure, since the lath structure has greater toughness. The patents also disclose that excess carbon in the lath regions precipitates during the cooling process to form cementite (iron carbide, $Fe_3C$) by a phenomenon known as "autotempering." The '968 patent discloses that autotempering can be avoided by limiting the choice of the alloying elements such that the martensite start temperature $M_s$ is 350° C. or greater. In certain alloys the carbides produced by autotempering add to the toughness of the steel while in others the carbides limit the toughness.

The dislocated lath structure produces a high-strength steel that is both tough and ductile, qualities that are needed for resistance to crack propagation and for sufficient formability to permit the successful fabrication of engineering components from the steel. Controlling the martensite phase to achieve a dislocated lath structure rather than a twinned structure is one of the most effective means of achieving the necessary levels of strength and toughness, while the thin films of retained austenite contribute the qualities of ductility and formability. Obtaining such a dislocated lath microstructure rather than the less desirable twinned structure is achieved by a careful selection of the alloy composition, which in turn affects the value of $M_s$.

The stability of the austenite in the dislocated lath microstructure is a factor in the ability of the alloy to retain its toughness, particularly when the alloy is exposed to harsh mechanical and environmental conditions. In certain conditions, austenite is unstable at temperatures above about 300° C., tending to transform to carbide precipitates which render the alloy relatively brittle and less capable of withstanding mechanical stresses. This instability is one of the issues addressed by the present invention.

SUMMARY OF THE INVENTION

It has now been discovered that carbon steel alloy grains having the dislocated lath microstructure described above tend to form multiple regions within a single grain structure that differ in the orientation of the austenite films. During the transformation strain that accompanies the formation of the dislocated lath structure, different regions of the austenite crystal structure undergo shear on different planes of the face-centered cubic (fcc) arrangement that is characteristic of austenite. While not intending to be bound by this explanation, the inventors herein believe that this causes the martensite phase to form by shear in various different directions throughout the grain, thereby forming regions in which the austenite films are at a common angle within each region but at a different angle between adjacent regions. Due to the austenite crystal structure, the result can be up to four regions, each with a different angle. This confluence of regions produces crystal structures in which the austenite films are of limited stability. Note that the grains themselves are encased in austenite shells at their grain boundaries, while the inter-grain regions of different austenite film orientations are not encased in austenite.

It has further been discovered that martensite-austenite grains of a dislocated lath structure with austenite films in a single orientation can be achieved by limiting the grain size to ten microns or less, and that carbon steel alloys with grains of this description have greater stability upon exposure to high temperatures and mechanical strain. This invention therefore resides in carbon steel alloys containing grains of dislocated lath microstructures, each grain having a single orientation of the austenite films, i.e., each grain being a single variant of the dislocated lath microstructure.

The invention further resides in a method of preparing such microstructures by heat soaking (austenitization of) the alloy composition to a temperature that places the iron entirely in the austenite phase and all alloying elements in solution, then deforming the austenite phase while maintaining this phase at a temperature just above its austenite recrystallization temperature to form small grains of 10 microns or less in diameter. This is followed by cooling the austenite phase rapidly to the martensite start temperature and through the martensite transition region to convert portions of the austenite to the martensite phase in the dislocated lath arrangement. This last cooling is preferably performed at a rate fast enough to avoid the formation of bainite and pearlite and the formation of any precipitates along the boundaries between the phases. The resulting microstructure consists of individual grains bounded by shells of austenite, each grain having the single-variant dislocated lath orientation rather than the multiple-variant orientation that limits the stability of the austenite. The alloy compositions suitable for use in this invention are those that allow the dislocated lath structure to form in this type of processing. These compositions have alloying elements and levels selected to achieve a martensite start temperature $M_s$ of at least about 300° C., and preferably at least about 350° C.

BRIEF DESCRIPTION OF THE DRAWINGS

FIG. 1 is a sketch representing the microstructure of the alloys of the prior art.

FIG. 2 is a sketch representing the microstructure of the alloys of the present invention.

DETAILED DESCRIPTION OF THE INVENTION AND PREFERRED EMBODIMENTS

To be able to form the dislocated lath microstructure, the alloy composition must be whose $M_s$ is about 300° C. or higher, and preferably 350° C. or higher. While alloying elements in general affect the $M_s$, the alloying element that has the strongest influence on the $M_s$ is carbon, and limiting the $M_s$ to the desired range is readily achieved by limiting the carbon content of the alloy to a maximum of 0.35% by weight. In preferred embodiments of the invention, the carbon content is within the range of from about 0.03% to about 0.35%, and in more preferred embodiments, the range is from about 0.05% to about 0.33%, all by weight.

It is further preferred that the alloy composition be selected to avoid ferrite formation during the initial cooling of the alloy from the austenite phase, i.e., to avoid the formation of ferrite grains prior to the further cooling of the austenite to form the dislocated lath microstructure. It is also preferred to include one or more alloying elements of the austenite stabilizing group, which consists of carbon (possibly already included as stated above), nitrogen, manganese, nickel, copper, and zinc. Particularly preferred among the austenite stabilizing elements are manganese and nickel. When nickel is present, its concentration is preferably within the range of about 0.25% to about 5%, and when manganese is present, its concentrations is preferably within the range of from about 0.25% to about 6%. Chromium is also included in many embodiments of the invention, and when it is present, its concentration is preferably from about 0.5% to about 12%. Again, all concentrations herein are by weight. The presence and levels of each alloying element can affect the martensite start temperature of the alloy, and as noted above, alloys useful in the practice of this invention are those whose martensite start temperature is at least about 350° C. Accordingly, selection of the alloying elements and their amounts will be made with this limitation in mind. The alloying element that has the greatest effect on the martensite start temperature is carbon, and limiting the carbon content to a maximum of 0.35% will generally ensure that the martensite start temperature is within the desired range. Further alloying elements, such as molybdenum, titanium, niobium, and aluminum, can also be present in amounts sufficient to serve as nucleation sites for fine grain formation yet low enough in concentration not to affect the properties of the finished alloy by their presence.

Preferred alloys of this invention also contain substantially no carbides. The term "substantially no carbides" is used herein to indicate that if any carbides are in fact present, the distribution and amount of precipitates are such that the carbides have a negligible effect on the performance characteristics, and particularly the corrosion characteristics, of the finished alloy. When carbides are present, they exist as precipitates embedded in the crystal structure, and their deleterious effect on the performance of the alloy will be minimized if the precipitates are less than 500 Å in diameter. The avoidance of precipitates located along the phase boundaries is particularly preferred.

As noted above, martensite-austenite grains of a single variant of the dislocated lath microstructure, i.e., with the martensite laths and austenite films oriented in a single orientation within each grain, are achieved by reducing the grain size to ten microns or less. Preferably, the grain size is within the range of about 1 micron to about 10 microns, and most preferably from about 5 microns to about 9 microns.

While this invention extends to alloys having the microstructures described above regardless of the particular metallurgical processing steps used to achieve the microstructure, certain processing procedures are preferred. These preferred procedures begin by combining the appropriate components needed to form an alloy of the desired composition, then homogenizing ("soaking") the composition for a sufficient period of time and at a sufficient temperature to achieve a uniform austenitic structure with all elements and components in solid solution. The temperature will be a temperature above the austenite recrystallization temperature, which may vary with the alloy composition, but in general will be readily apparent to those skilled in the art. In most cases, best results will be achieved by soaking at a temperature within the range of 1050° C. to 1200° C. Rolling, forging or both are optionally performed on the alloy at this temperature.

Once homogenization is completed, the alloy is subjected to a combination of cooling and grain refinement to the desired grain size, which as noted above is ten microns or less, with narrower ranges preferred. The grain refinement may be performed in stages, but the final grain refinement is generally achieved at an intermediate temperature that is above, yet close to, the austenite recrystallization temperature. In this preferred process, the alloy is first rolled (i.e., subjected to dynamic recrystallization) at the homogenization temperature, then cooled to the intermediate temperature and rolled again for further dynamic recrystallization. For carbon steel alloys of this invention in general, this intermediate temperature is between the austenite recrystallization temperature and a temperature that is about 50 degrees above the austenite recrystallization temperature. For the preferred alloy compositions noted above, the austenite recrystallization temperature is about 900° C., and therefore the temperature to which the alloy is cooled at this stage is preferably a temperature within the range of about 900° to about 950° C., and most preferably a temperature within the range of about 900° to about 925° C. Dynamic recrystallization is achieved by conventional means, such as controlled rolling, forging, or both. The reduction created by the rolling amounts to 10% or greater, and in many cases the reduction is from about 30% to about 60%.

Once the desired grain size is achieved, the alloy is rapidly quenched by cooling from above the austenite recrystallization temperature down to $M_s$ and through the martensite transition range to convert the austenite crystals to the dislocated packet lath microstructure. The resulting packets are of approximately the same small size as the austenite grains produced during the rolling stages, but the only austenite remaining in these grains is in the thin films and in the shell surrounding each grain. As noted above, the small size of the grain ensures that the grain is only a single variant in the orientation of the austenite thin films.

As an alternative to dynamic recrystallization, grain refinement can be effected by a double heat treatment in which the desired grain size is achieved by heat treatment alone. In this alternative, the alloy is quenched as described in the preceding paragraph, then reheated to a temperature in the vicinity of the austenite recrystallization temperature, or slightly below, then quenched once again to achieve, or return to, the dislocated lath microstructure. The reheating temperature is preferably within about 50 degrees Celsius of the austenite recrystallization temperature, for example about 870° C.

In preferred embodiments of the invention, the quenching stage of each of the processes described above is performed at a cooling rate great enough to avoid the formation of carbide precipitates such as bainite and pearlite, as well as nitride and carbonitride precipitates, depending on the alloy composition, and also the formation of any precipitates along the phase boundaries. The terms "interphase precipitation" and "interphase precipitates" are used herein to denote precipitation along phase boundaries and refers to the formation of small deposits of compounds at locations between the martensite and austenite phases, i.e., between the laths and the thin films separating the laths. "Interphase precipitates" does not refer to the austenite films themselves. The formation of all of these various types of precipitates, including bainite, pearlite, nitride, and carbonitride precipitates, as well as interphase precipitates, is collectively referred to herein as "autotempering."

The minimum cooling rates needed to avoid autotempering are evident from the transformation-temperature-time diagram for the alloy. The vertical axis of the diagram represents temperature and the horizontal axis represents time, and curves on the diagram indicate the regions where each phase exists either by itself or in combination with another phase(s). A typical such diagram is shown in Thomas, U.S. Pat. No. 6,273,968 B1, referenced above. In such diagrams, the minimum cooling rate is a diagonal line of descending temperature over time which abuts the left side of a C-shaped curve. The region to the right of the curve represents the presence of carbides, and acceptable cooling rates are therefore those represented by lines that remain to the left of the curve, the slowest of which has the smallest slope and abuts the curve.

Depending on the alloy composition, a cooling rate that is sufficiently great to meet this requirement may be one that requires water cooling or one that can be achieved with air cooling. In general, if the levels of certain alloying elements in an alloy composition that is air-coolable and still has a sufficiently high cooling rate are lowered, it will be necessary to raise the levels of other alloying elements to retain the ability to use air cooling. For example, the lowering of one or more of such alloying elements as carbon, chromium, or silicon may be compensated for by raising the level of an element such as manganese. Whatever adjustments are made to individual alloying elements, however, the final alloy composition must be one having an $M_s$ is above about 300° C., and preferably above about 350° C.

The processing procedures and conditions set forth in the U.S. patents referenced above may be used in the practice of the present invention for such such steps as heating the alloy composition to the austenite phase, cooling the alloy with controlled rolling or forging to achieve the desired reduction and grain size, and quenching the austenite grains through the martensite transition region to achieve the dislocated lath structure. These procedures include castings, heat treatment, and hot working of the alloy such as by forging or rolling, finishing at the controlled temperature for optimum grain refinement. Controlled rolling serves various functions, including aiding in the diffusion of the alloying elements to form a homogeneous austenite crystalline phase and in the storage of strain energy in the grains. In the quenching stages of the process, controlled rolling guides the newly forming martensite phase into a dislocated lath arrangement of martensite laths separated by thin films of retained austenite. The degree of rolling reduction can vary, and will be readily apparent to those skilled in the art. Quenching is preferably done fast enough to avoid bainite, pearlite, and interphase precipitates. In the martensite-austenite dislocated lath crystals, the retained austenite films will constitute from about 0.5% to about 15% by volume of the microstructure, preferably from about 3% to about 10%, and most preferably a maximum of about 5%.

A comparison of FIGS. 1 and 2 demonstrates the distinction between the present invention and the prior art. FIG. 1 represents the prior art, showing a single grain 11 with a dislocated lath structure. The grain contains four internal regions 12, 13, 14, 15, each of which consists of dislocated laths 16 of martensite separated by thin films 17 of austenite, the austenite films in each region having a different orientation (i.e., being a different variant) than those in the remaining regions. Contiguous regions thus have a discontinuity in the dislocated lath microstructure. The exterior of the grain is a shell 18 of austenite, while the boundaries between the regions 19 (indicated by dashed lines) are not occupied by any discrete crystal structure of precipitates but merely indicate where one variant ends and another begins.

FIG. 2 depicts two grains 21, 22 of the present invention, each grain consisting of dislocated laths 23 of martensite separated by thin films 24 of austenite in only a single variant in terms of austenite film orientation and yet with the outer shell 25 of austenite. The variant of one grain 21 differs from that of the other 22 but within each grain is only a single variant.

The foregoing is offered primarily for purposes of illustration. Further modifications and variations of the various parameters of the alloy composition and the processing procedures and conditions may be made that still embody the basic and novel concepts of this invention. These will readily occur to those skilled in the art and are included within the scope of this invention.

What is claimed is:

1. An alloy carbon steel having a martensite start temperature of at least about 350° C. and comprising martensite-austenite grains 5 microns to 9 microns in diameter, each grain bounded by an austenite shell and having a microstructure containing laths of martensite alternating with thin films of austenite in a uniform orientation throughout said grain, and any carbides present in said alloy carbon steel are precipitates of less than 500 Å in diameter.

2. The alloy carbon steel of claim 1 having a maximum of 0.35% carbon by weight.

3. The alloy carbon steel of claim 1 having carbon as an alloying element at a concentration of from about 0.05% to about 0.33% by weight.

4. The alloy carbon steel of claim 1 in which any silicon present amounts to less than 1% by weight.

5. The alloy carbon steel of claim 1 further comprising from about 2% to about 12% chromium by weight.

6. The alloy carbon steel of claim 1 further comprising at least about 1% by weight of a member selected from the group consisting of nickel and manganese.

7. The alloy carbon steel of claim 1 further comprising from about 1% to about 6% of a member selected from the group consisting of nickel and manganese.

8. The alloy carbon steel of claim 1 comprising from about 0.05% to about 0.33% carbon, from about 0.5% to about 12% chromium, from about 0.25% to about 5% of nickel, from about 0.26% to about 6% manganese, and less than 1% silicon, all by weight.

* * * * *